US008794710B2

(12) United States Patent
Howard et al.

(10) Patent No.: US 8,794,710 B2
(45) Date of Patent: Aug. 5, 2014

(54) DEEP UNDERSEA MINING SYSTEM AND MINERAL TRANSPORT SYSTEM

(75) Inventors: Robert James Howard, Clifton, VA (US); John W. Rapp, Manassas, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 1222 days.

(21) Appl. No.: 12/505,329

(22) Filed: Jul. 17, 2009

(65) Prior Publication Data

US 2011/0010967 A1 Jan. 20, 2011

(51) Int. Cl.
*E21C 45/00* (2006.01)

(52) U.S. Cl.
USPC ..... 299/9

(58) Field of Classification Search
USPC ..... 175/6, 60; 299/9; 406/86; 137/195, 307, 137/309, 313, 314, 317, 321–324, 320, 338, 137/339, 341; 423/DIG. 4; 114/313, 321, 114/44, 50–54
See application file for complete search history.

(56) References Cited

U.S. PATENT DOCUMENTS

| | | | | |
|---|---|---|---|---|
| 1,344,505 | A * | 6/1920 | Grumme | 114/51 |
| 3,171,219 | A * | 3/1965 | Kaufmann et al. | 37/313 |
| 3,513,081 | A * | 5/1970 | Wanzenberg et al. | 205/766 |
| 3,683,699 | A * | 8/1972 | Grady | 73/864.71 |
| 4,010,560 | A | 3/1977 | Diggs | |
| 4,052,800 | A | 10/1977 | Fuhrboter et al. | |
| 4,231,171 | A | 11/1980 | Balligand et al. | |
| 4,336,662 | A | 6/1982 | Baird | |
| 4,681,372 | A | 7/1987 | McClure | |
| 4,690,087 | A * | 9/1987 | Hadjis | 114/50 |
| 4,802,292 | A | 2/1989 | Masuda | |
| 4,878,711 | A * | 11/1989 | Vinot et al. | 299/9 |
| 4,910,912 | A * | 3/1990 | Lowrey, III | 47/62 R |
| 5,199,767 | A * | 4/1993 | Jimbo | 299/8 |
| 5,328,250 | A | 7/1994 | Upright | |
| 6,843,191 | B1 * | 1/2005 | Makotinsky | 114/51 |

FOREIGN PATENT DOCUMENTS

| | | | |
|---|---|---|---|
| DE | 3035904 | A1 * | 4/1982 |
| DE | 3221014 | A1 | 12/1983 |
| DE | 3224542 | A * | 1/1984 |
| DE | 4039473 | A1 | 6/1992 |
| FR | 2648510 | A1 | 12/1990 |

(Continued)

OTHER PUBLICATIONS

Machine Translation of German document DE 3035904, dated Jan. 10, 2014.*

(Continued)

*Primary Examiner* — Sunil Singh
(74) *Attorney, Agent, or Firm* — Kaplan Breyer Schwarz & Ottesen, LLP

(57) ABSTRACT

Systems and methods for recovering manganese nodules from the seabed are disclosed. A buoyant body is generated by freezing water, forming a clathrate ice, or using a liquid that is less dense than seawater. Nodules that have been collected from the seabed are incorporated into or otherwise coupled to the buoyant body. The buoyant body is then released to make a free or tethered ascent to the surface.

10 Claims, 15 Drawing Sheets

(56) References Cited

FOREIGN PATENT DOCUMENTS

| | | | | |
|---|---|---|---|---|
| FR | 2650859 | A1 | | 2/1991 |
| JP | 2003269070 | A | * | 9/2003 |
| NL | 7705122 | A | * | 11/1978 |
| NL | 7804897 | A | * | 9/1979 |
| RU | 2030582 | C1 | | 3/1995 |
| SU | 1446518 | A | * | 12/1989 |
| SU | 1446520 | A | * | 12/1989 |

OTHER PUBLICATIONS

Isliy, Saida, "PCT Application No. PCT/US2010/039627 Partial International Search Report Sep. 16, 2010", , Publisher: PCT, Published in: PCT.

Papadimitriou, S., "PCT Application No. PCT/US2010/039627 International Search Report Oct. 26, 2010", , Publisher: PCT, Published in: PCT.

Papadimitriou, S., "PCT Application No. PCT/US2010/039627 International Preliminary Report on Patentability Jul. 4, 2011", , Publisher: PCT, Published in: PCT.

* cited by examiner

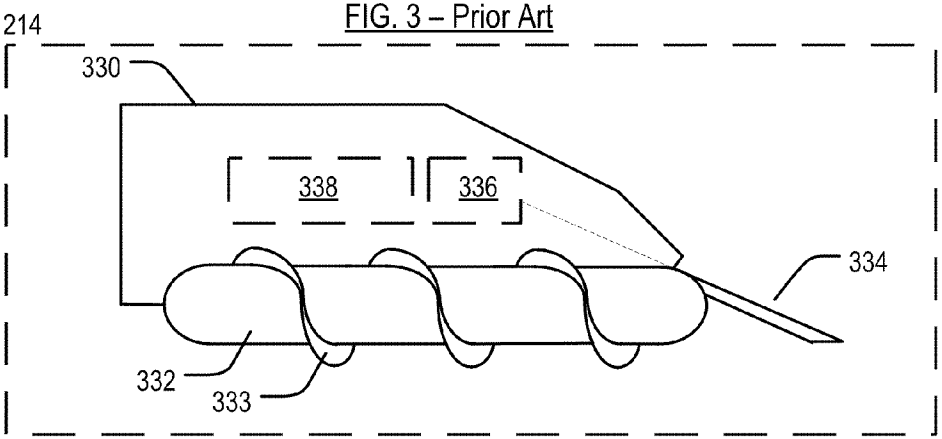
FIG. 3 – Prior Art
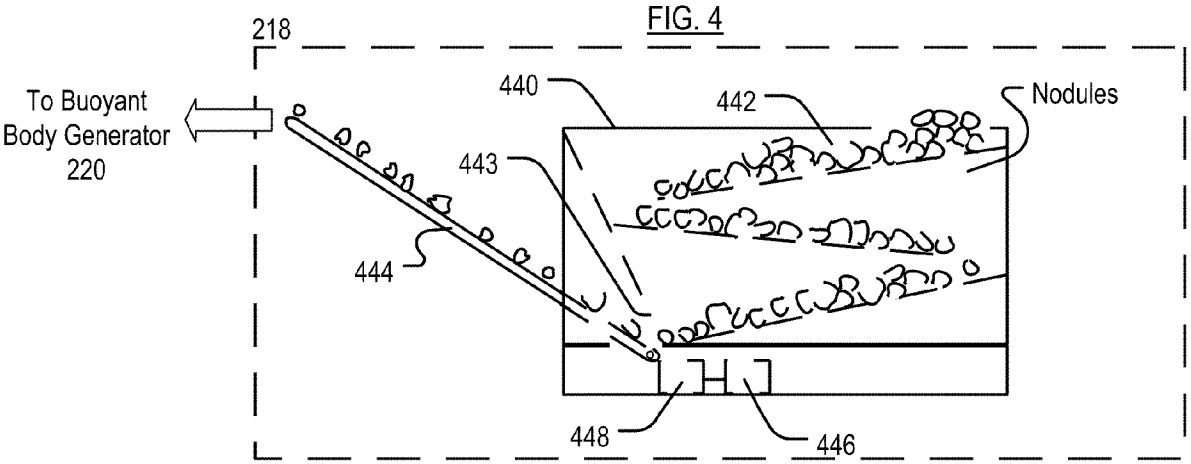
FIG. 4

DEEP UNDERSEA MINING SYSTEM AND MINERAL TRANSPORT SYSTEM

FIELD OF THE INVENTION

The present invention relates to undersea mining.

BACKGROUND OF THE INVENTION

As the prices of minerals rise, deep-sea mineral mining becomes an economically-viable alternative to surface mining. There are two primary sources of minerals in the deep sea: "black smokers" and "manganese nodules."

Black smokers are chimney-like structures, two to five meters in height, which form around breaks in the sea floor. Boiling water that escapes from within the earth through these breaks carries up large amounts of copper, manganese, nickel, gold, cobalt, zinc, and other minerals. As the hot liquid enters the cold deep-ocean water, the entrained metals deposit onto the surrounding ocean floor, forming characteristic columns or chimney-like structures.

Manganese nodules, also called polymetallic nodules, are rock concretions that lie partly or completely buried on the sea floor. The nodules vary in size from microscopic to large coconut-size structures. They vary greatly in abundance; at some locations, the nodules cover more than 70 percent of the ocean bottom. Nodules can be found at any depth, but the greatest concentration is usually found on vast abyssal plains in the deep ocean between 4,000 and 6,000 meters. The total amount of manganese nodules on the sea floor has been estimated at 500 billion tons.

Manganese nodules consist of concentric layers of minerals around a core, which is typically a shell of a microfossil, a phosphatized shark tooth, basalt debris, or fragments from earlier nodules. Nodule growth is extremely slow; approximately one centimeter per several million years. Several processes are involved in the formation of manganese nodules. These processes include: the precipitation of metals from seawater, the remobilization of manganese in the water column, the derivation of metals from hot springs associated with volcanic activity, the decomposition of basaltic debris by seawater, and the precipitation of metal hydroxides through the activity of microorganisms. Several of these processes may operate concurrently or they may follow one another during the formation of a nodule.

The chemical composition of nodules varies according to the minerals present, and the size and characteristics of the core. The nodules of greatest economic interest have the following composition: manganese (27-30%), nickel (1.25-1.5%), copper (1-1.4%) and cobalt (0.2-0.25%). Other constituents include iron (6%), silicon (5%) and aluminum (3%), and lesser amounts of calcium, sodium, magnesium, potassium, titanium and barium.

A major challenge to recovering nodules from the deep ocean is how to economically transport them to the surface. At 6000 meters, pressures are about $6\times10^7$ Pascals (about 9000 psi). A minimum of about 60 kilojoules of energy per kilogram of mineral is required for transport to the surface.

Presently, there are only a few ways to transport nodules to the surface. One way is to use an underwater vacuum system. This approach has been demonstrated, but it is quite expensive, both in terms of capital outlay and energy consumption. A second approach uses a vehicle (e.g., a UUV, etc.) that shuttles between the sea bottom and the surface. But this approach is also quite expensive due to capital outlay and energy consumption.

A third approach uses a buoyancy-based recovery system. One such system is disclosed in U.S. Pat. No. 4,010,560, wherein balloons or flexible containers are filled with a gas to lift ore from the sea bed. Using gas to create a buoyant body is difficult and impractical due to the high pressures involved and the high energy costs. A second buoyancy-based system, which is disclosed in U.S. Pat. No. 4,336,662, relies on fixed volume constant-buoyancy bodies (e.g., cork, etc.) that are transported to the ocean bottom using a mass that is discarded upon reaching the ocean bottom. This approach raises environmental concerns (i.e., discarding the material in the ocean) and poses a risk that the discarded material might cover valuable minerals.

SUMMARY OF THE INVENTION

The present invention provides a way to recover minerals from the sea bed that avoids some of the costs and disadvantages of the prior art. The present invention provides a system and method of reduced complexity and, hence, capital outlay, as well as reduced energy cost, compared to the prior art.

The illustrative embodiment of the invention is a deep undersea mining system comprising a mineral transport system. In some embodiments, the mining system includes: a system controller, a nodule collector, a nodule storage facility, a buoyant body generator, and a transport system.

In some embodiments, the system controller is disposed on a platform that is floating at the surface of the ocean. Nodules that are recovered from the seabed are ultimately brought onto the platform. One or more nodule collectors operate on the seabed recovering manganese nodules. The nodule collectors include storage for collected nodules. In some embodiments, the nodules are delivered to intermediate storage, such as a nodule storage facility.

Nodules are delivered by conveyor from storage, or directly by the nodule collector(s), to the buoyant body generator. The buoyant body generator creates a buoyant body. The buoyant body provides the motive force—buoyancy—to lift manganese nodules from the sea bed to the surface. Gases and cork have been used in the prior art to provide the buoyancy necessary to recover minerals from the seabed. The embodiments disclosed herein, however, are different from these prior art approaches. In particular, in some embodiments, the buoyant body comprises:

(1) ice that is formed at depth by freezing seawater or fresh water; or
(2) a liquid that is less dense than seawater; or
(3) using (1) or (2) in combination with gas that is generated (at a prescribed depth); or
(4) clathrate ice.

The buoyant bodies disclosed herein provide advantages relative to the gas-based and cork-based buoyant bodies of the prior art.

In some embodiments, the buoyant body is guided to the surface, such as via a tether or other means. In some other embodiments, the lift body makes a free ascent to the surface. But in all embodiments, the buoyant body is integral to transporting the nodules to the surface.

Some embodiments of the present invention provide a system for transporting a payload from the seabed to the surface of the sea. In some embodiments, that system comprises a buoyant-body generator and, optionally, a discrete transport system.

Some other embodiments of the present invention provide a deep undersea mining system. In some embodiments, that undersea mining system comprises a nodule collector, optional nodule storage facility, a buoyant-body generator, and, optionally, a discrete transport system.

Some further embodiments provide a method for transporting a payload from the seabed to the surface of the sea. In some embodiments, that method comprises the operations of "forming a buoyant body under water," "coupling a payload to the buoyant body," and "causing the buoyant body and the payload to ascent to the surface of the water." Yet additional embodiments provide a method for deep undersea mining. Some of those embodiments comprise the operations of "collecting a payload" and an optional operation of "temporarily storing the payload," in addition to the operations recited in the method for "transporting a payload from the seabed to the surface of the sea."

Additional embodiments are described in further detail below and presented in the appended drawings.

BRIEF DESCRIPTION OF THE DRAWINGS

FIG. 3 depicts a conventional nodule collector for use in conjunction with the underwater mining systems described in this specification.

FIG. 4 depicts an embodiment of a nodule storage facility for use in conjunction with the underwater mining systems described in this specification.

DETAILED DESCRIPTION

Figure 1:
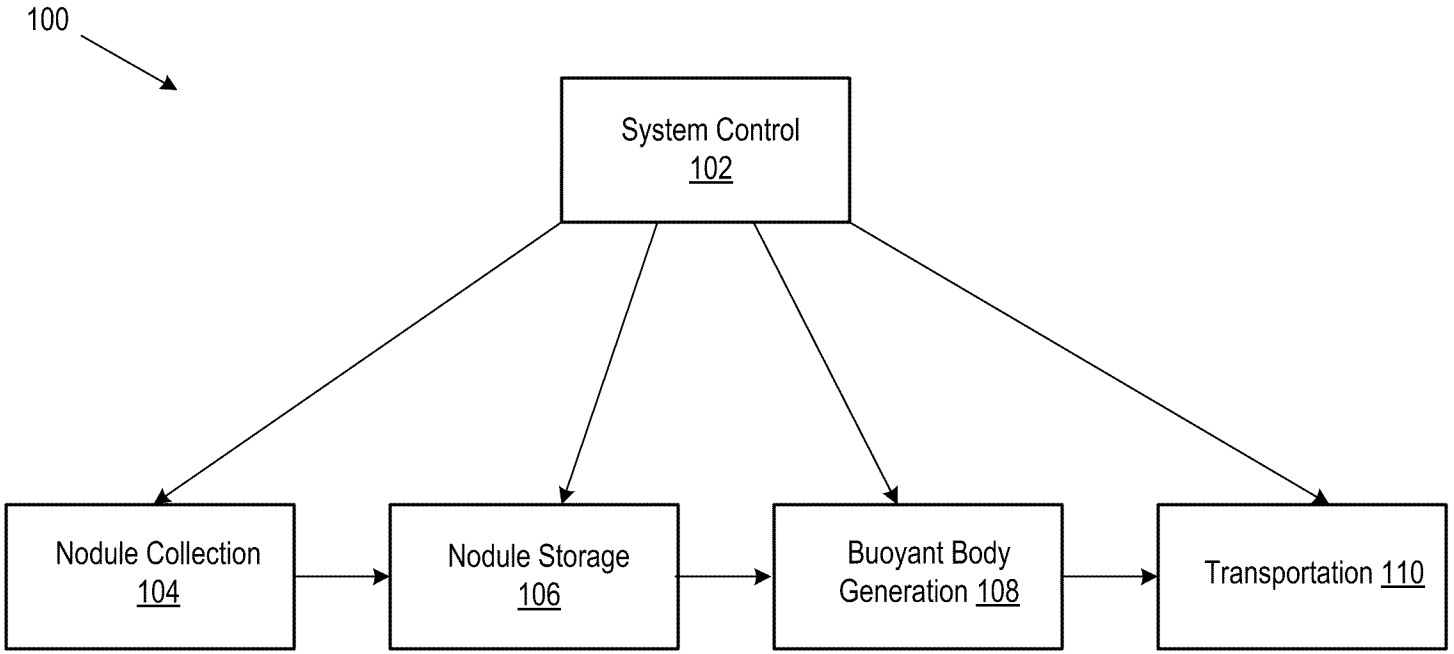
FIG. 1 depicts, via a block representation, an underwater mining system in accordance with the illustrative embodiment of the present invention.

FIG. 1 depicts functional elements of system 100 for underwater mining in accordance with the illustrative embodiment of the present invention. The system comprises system control 102, nodule collection 104, nodule storage 106, buoyant-body generation 108, and transport 110.

Nodule-collection functionality 104 is responsible for collecting manganese nodules from the seabed. This functionality can be implemented via a variety of different mechanisms. A specific embodiment of a nodule collector suitable for carrying out this function is described in further detail later in this specification in conjunction with FIGS. 2 and 3.

Collected manganese nodules are typically stored for some period of time (for convenience) before they are transported to the surface. In most embodiments, nodule-storage functionality 106 is provided, in part, by the nodule collector, which will typically include some amount of "on-board" storage volume. Nodule-storage functionality 106 is also provided, in some embodiments, via a separate nodule storage facility. To the extent that multiple nodule collectors are operating on the seabed, the nodule storage facility simplifies handling and logistics issues. A specific embodiment of a nodule storage facility for providing nodule storage functionality 106 is described in further detail in conjunction with FIGS. 2 and 4.

Buoyant-body generation function 108 provides a buoyant body. The purpose of the buoyant body is to provide the motive force—buoyancy—for raising collected manganese nodules to the surface. In other words, the buoyant body and some of the collected nodules will rise from the seabed to the surface due to the fact that the average density of the buoyant body and the accompanying nodules is less than that of seawater. In some embodiments, the manganese nodules are encapsulated in the buoyant body during formation. Buoyant-body generation function 108 is described in further detail in conjunction with FIGS. 2, 5, 7A-7C, 8A-8B, 9A-9C, and 15, which depict various embodiments of buoyant-body generators and the operation thereof.

Transport functionality 110 is responsible for conveying the buoyant body to the surface. In some embodiments, the buoyant body itself functions as a transport system. In some other embodiments, the transport functionality is provided by a distinct system. Transport functionality 110 is described in further detail in conjunction with FIGS. 2, 7C, 9C, 10, 11, 12, 13, 14A-14B, and 15.

System control functionality 102 is responsible for directing the activities of the various elements of system 100. In some embodiments, the control functionality includes both a processor running appropriate software as well as an interface for remote-controlled operation (by a human operator) of one or more elements of system 100 (e.g., nodule collector 104, etc.). In some embodiments, the system control functionality is implemented partially or fully topside on a platform. In other more autonomously-operating embodiments, the system control functionality, or at least a portion of, is implemented via a processor located in one or more of the elements of system 100 that are operating on the seabed.

Figure 2:
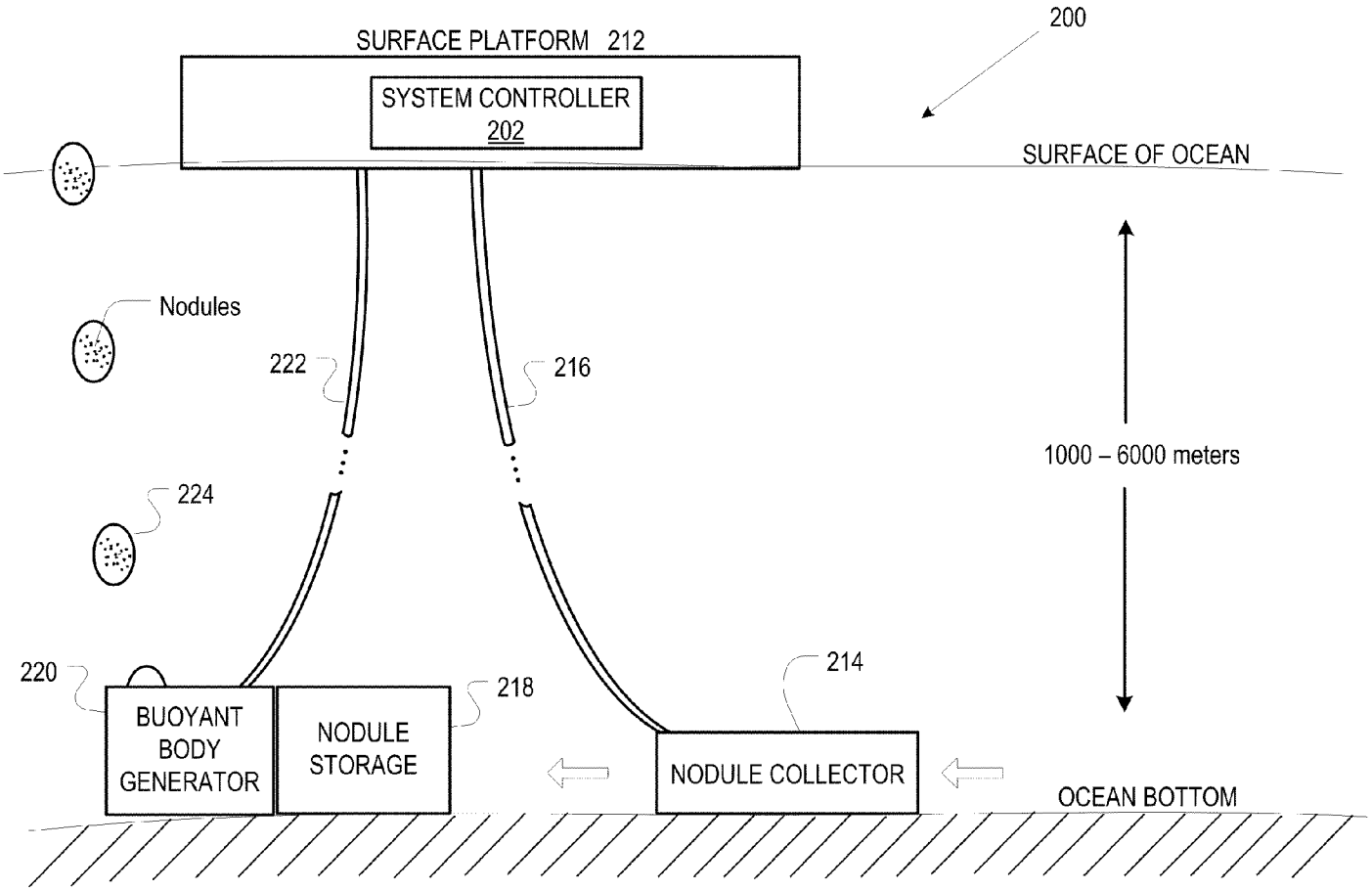
FIG. 2 depicts a first embodiment of the system of FIG. 1.

FIG. 2 depicts first embodiment 200 of system 100. In this embodiment, transport functionality 110 is implemented via the buoyant body itself. That is, there is no separate or distinct transport system.

In this embodiment, system control functionality 102 is implemented via system controller 202, nodule collection functionality 104 is implemented via conventional nodule collector 214, nodule storage functionality 106 is implemented via nodule storage facility 218, and buoyant-body generation functionality 108 is implemented via buoyant-body generator 220.

System controller 202 is disposed on floating platform 212. As described in further detail below, system controller 202 controls various elements of system 200, such as, for example, nodule collector 214, storage facility 218, and buoyant body generator 220. Control signals are transmitted to the various underwater elements via a cable, such as cables 216 and/or 218.

In system 200, nodule collector 214 is a self-propelled, nodule-collecting vehicle. A variety of designs exist for nodule collectors. See, for example, U.S. Pat. Nos. 4,231,171 and 5,328,250, which are incorporated by reference herein. These patents disclose machines that move across the seabed scooping up nodules. These machines or others known to those skilled in the art can suitably serve as nodule collector 214 for use in conjunction with system 100.

FIG. 3 depicts further detail of nodule collector 214. The nodule collector depicted in FIG. 3 is representative of the type of nodule collector disclosed in the previously referenced patents. Nodule collector 214 comprises body 330, propulsion units 332, dredge 334, conveyor 336 and power/control/drive systems 338.

Body 330 houses a storage silo (not depicted) for the collected nodules and houses other systems as well, such as conveyor 336 and power/control/drive systems 338. Propulsion units 332 (one unit is disposed on each side of body 330) include helical fin 333 that engages the seabed. As propulsion unit 332 turns, helical fin 333 moves collector 214 along the seabed. Dredge 334 is adjustable to provide a variable level of seabed penetration. Associated with the dredge is conveyor 336 for raising the nodules into body 330 and for directing the nodules into the storage silo therein.

Collector 214 also includes power/control/drive systems 338. In some embodiments, the power system comprises energy storage (e.g., batteries, etc.) and a power distribution system. In the illustrative embodiment depicted in FIG. 2, collector 214 receives power through cable 216, which transmits power from a generator, etc., disposed on platform 212. Control signals are also transmitted from system controller 202 through cable 216 to control the operation of propulsion units 332, dredge 334, and other subsystems aboard collector 214, either directly or through the operation of the on-board control system. A remote operator on platform 212 can control the movements of collector 214 based on images that are received from television cameras on-board on the collector. The signal from controller 202 is also transmitted through cable 216. In some alternative embodiments, collector 214 is partially or completely autonomous, wherein onboard systems respond to directives from the onboard controller, as previously stored in memory, or use sonar, etc. to guide movements.

Referring now to FIGS. 2 and 4, nodule storage functionality 106 is implemented via nodule storage facility 218. The facility has a greater nodule storage capacity than collector 214 and is therefore capable of receiving multiple loads of nodules as received from plural collectors 214 that might be operating in the vicinity. In some embodiments, collector 214 includes a system for emptying its onboard storage silo into nodule storage facility 218 or onto a conveyor that empties into facility 218. In some other embodiments, the system for emptying the onboard storage silo is associated with nodule storage facility 218 (e.g., a vacuum-type system, etc.).

As depicted in FIG. 4, storage facility 218 comprises housing 440 and storage region 442 within the housing. Storage region includes opening 443 through which nodules flow, via gravity, onto conveyor 444. Additional mechanisms/devices can be used to promote the movement of nodules to and through opening 443 (e.g., agitation devices, etc.) Conveyor 444 is driven by motor 448 under the control of controller 446. In some embodiments, controller 446 receives commands from system controller 202 and directs the operation of conveyor 444 accordingly.

With continuing reference to FIG. 2, nodules are conveyed from storage facility 218 to buoyant-body generator 220. Buoyant-body generator 220 is configured to create and release buoyant bodies 224. Each buoyant body is positively buoyant and its buoyancy is the motive force for "lifting" nodules from the seabed to the surface. As described later in this specification, in some embodiments, the buoyant body comprises ice. In some of these embodiments, the ice is optionally contained in a thermally-insulating "skin" or bladder to reduce the rate at which the ice melts. In yet some further embodiments, the buoyant body comprises a liquid that is necessarily contained a skin/bladder. In some further embodiments, gas is generated to supplement buoyancy in conjunction with the use of liquid or especially ice.

Figure 5:
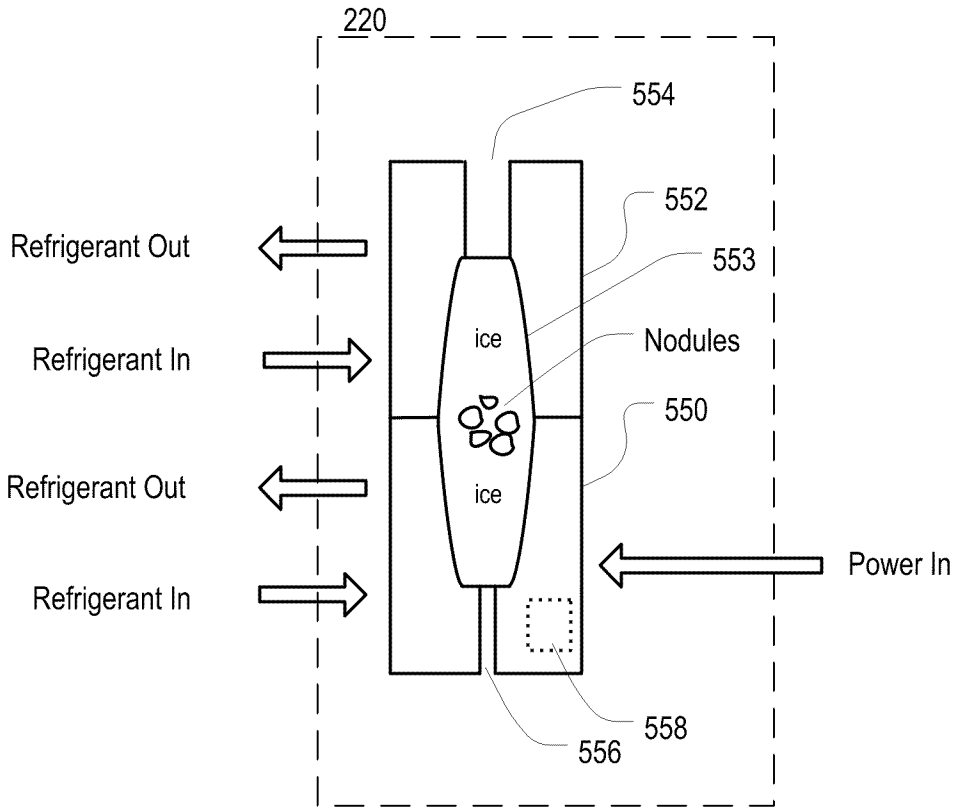
FIG. 5 depicts a first embodiment of a buoyant body generator for use in conjunction with the underwater mining systems described in this specification.

FIG. 5 depicts a first embodiment of buoyant-body generator 220. In the embodiment that is depicted in FIG. 5, buoyant-body generator 220 freezes water to form ice. Buoyant-body generator 220 comprises lower jacket 550, upper jacket 552, nodule inlet 554, brine drain 556, and controller 558. The lower and upper jackets are independently refrigerated. When closed as depicted in FIG. 5, lower jacket 550 and upper jacket 552 collectively define refrigeration chamber 553.

The refrigeration chamber has a truncated elliptical shape in the embodiment depicted in FIG. 5. In other embodiments, the refrigeration chamber is spherical. In conjunction with the present disclosure, those skilled in the art will know how to design a refrigeration chamber having a desired shape, based on manufacturing or other concerns.

In the illustrative embodiment, water—either seawater or fresh water—is introduced into refrigeration chamber 553 of buoyant-body generator 220. The chamber is filled approximately half way (i.e., to the top of lower jacket 550) with water. At this point, only the lower jacket 550 of generator 220 is operated, freezing the water to form the lower "half" of the ellipse-shaped buoyant body. Nodules are then admitted into the refrigeration chamber via nodule inlet 554 and are directed to the flat, now-frozen surface of the nascent buoyant body. Additional water is then added to refrigeration chamber 553 and upper jacket 552 is operated to freeze the water, thereby encasing the nodules in what has become the buoyant body. Generator 220 is controlled by controller 558, which, in some embodiments, receives instructions from system controller 202 (FIG. 2).

As previously indicated, generator 220 uses either fresh water or seawater to produce the ice. With regard to seawater, as the surface of salt water begins to freeze (at −1.9° C. for normal salinity seawater, 3.5%) the ice that forms is essentially "salt free" with a density approximately equal to that of freshwater ice. This ice floats on the surface and the salt that is "frozen out" adds to the salinity and density of the seawater just below it, in a process known as "brine rejection." This denser saltwater sinks by convection and the replacing seawater is subject to the same process. This provides essentially freshwater ice at −1.9° C. on the surface. The increased density of the seawater beneath the forming ice causes it to sink towards the bottom of refrigeration chamber 553. This "brine" is removed via brine drain 556.

Figure 6:
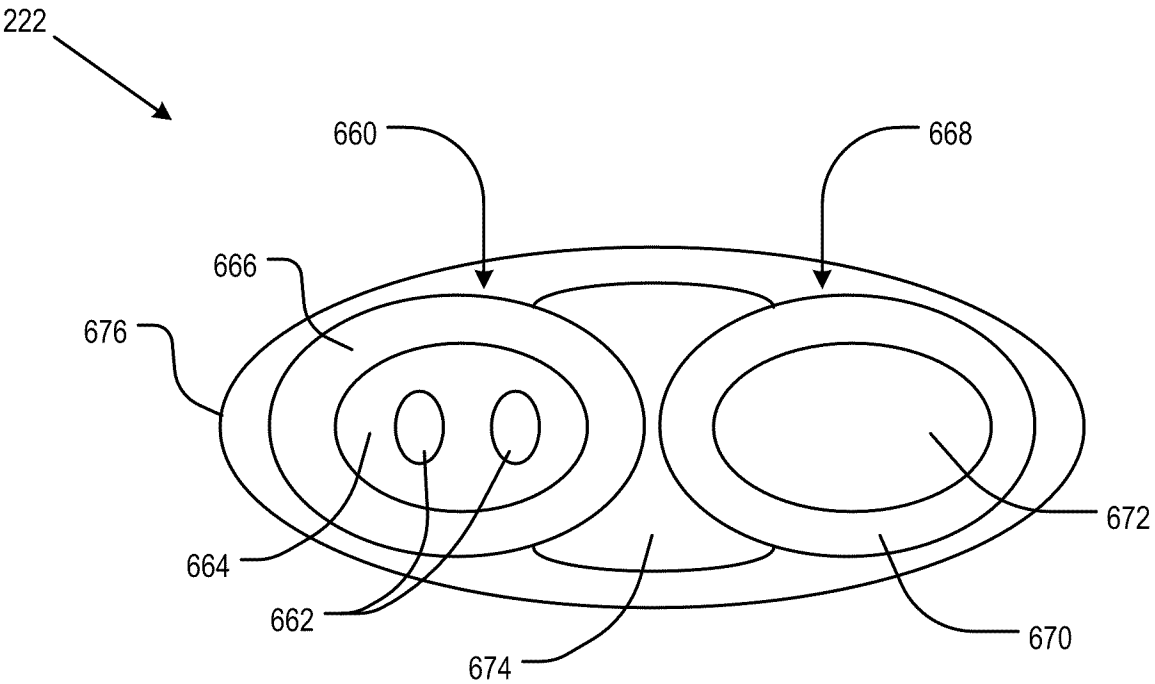
FIG. 6 depicts an embodiment of a multi-functional tether for use in conjunction with the underwater mining systems described in this specification.

Fresh water can be transported from the surface to buoyant-body generator 220. This can be done, for example, via conduit 222, an embodiment of which is depicted via cross section in FIG. 6. Conduit 222 provides both power, via power line 660, and fluid, via fluid line 668, to buoyant-body generator 220. In some embodiments, conduit 222 also provides for the transmission of control signals, such as from controller 202.

Power line 660 comprises two conductors 662 surrounded by electrical insulation 664 and encased in strength member 666 (Kevlar® fabric, etc.). Fluid line 668 comprises outer wall 670 and fluid-conducting lumen 672. In the illustrative embodiment, power line 660 and fluid line 668 are separated by electrical insulation 674 and encased in outer layer 676.

In some embodiments, conduit 222 also includes a signal-carrying line (not depicted), for transmitting command signals, etc., from top-side controller 202 to various underwater elements requiring the signal (e.g., buoyant body generator 220, etc.).

As an alternative to transporting fresh water from the surface, desalinated water can be produced at depth via reverse osmosis. Although this approach avoids the use of exceedingly-long hoses, it does require significant quantities of energy. The reverse osmosis pressure is about 26 atmospheres for seawater. This translates to a minimum energy per kilogram of nodules lifted of about 130 kilojoules. In practice, considering the losses in the reverse osmosis membrane and the excess ice required for lift, this number will probably be closer to 500 kilojoules per kilogram of nodules. This compares (unfavorably) with a practical energy requirement about 120 kilojoules per kilogram of nodule for piping fresh water down to the seabed.

Figure 7C:
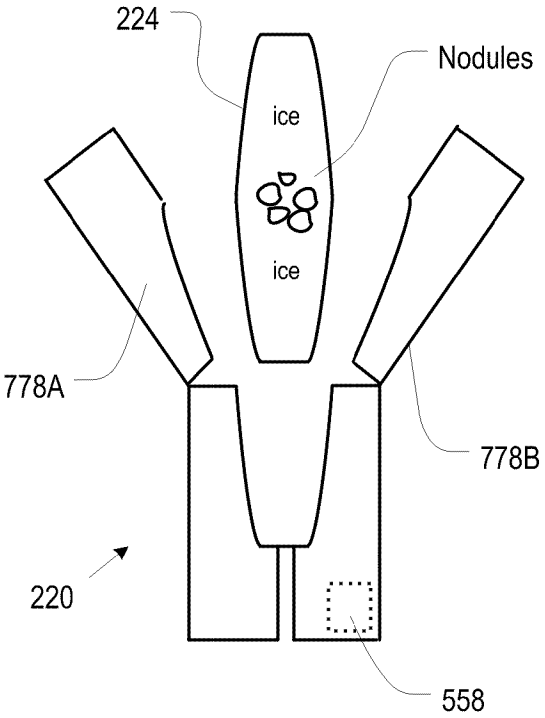
FIGS. 7A-7C depicts a method for generating a buoyant body using the buoyant body generator of FIG. 5.
Figure 7B:
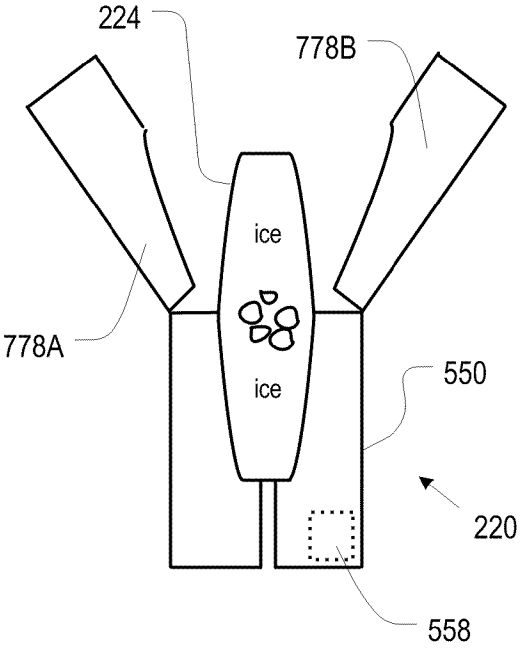
Figure 7A:
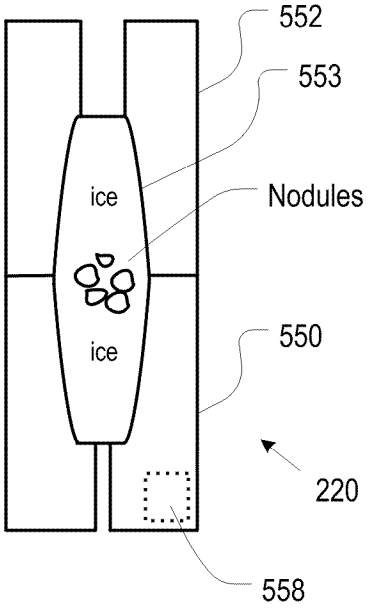

FIGS. 7A through 7C depict the release of buoyant body 224 that is formed by buoyant-body generator 220. FIG. 7A depicts nodules within the ice in chamber 553 of the buoyant-body generator. FIG. 7B depicts the upper jacket opening in preparation for the release of newly-formed buoyant body 224. In the embodiment depicted in FIG. 7B, upper jacket 552 is segmented into two halves, depicted as segments 778A and 778B, which are hingeably connected to lower jacket 550. FIG. 7C depicts buoyant body 224 after its release from the buoyant body generator.

Figure 8B:
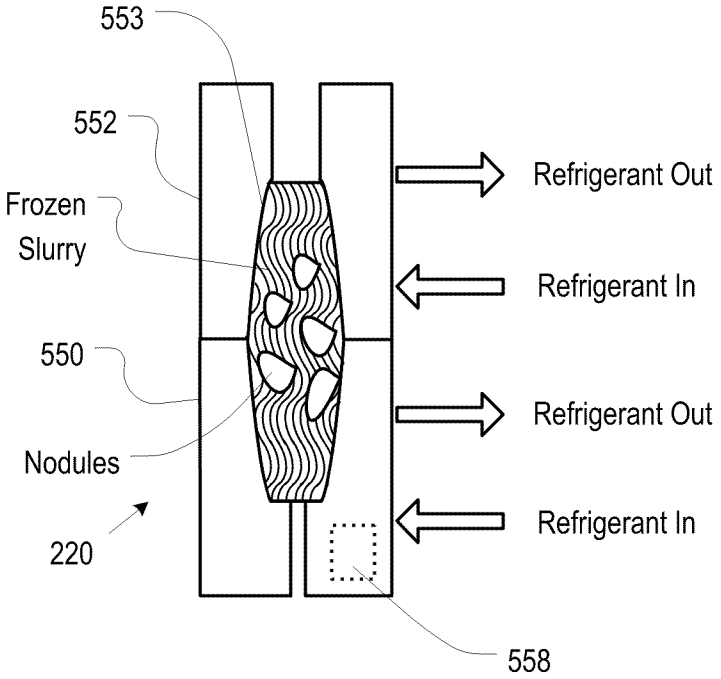
FIG. 8B depicts a second alternative embodiment for generating a buoyant body using the buoyant body generator of FIG. 5.
Figure 8A:
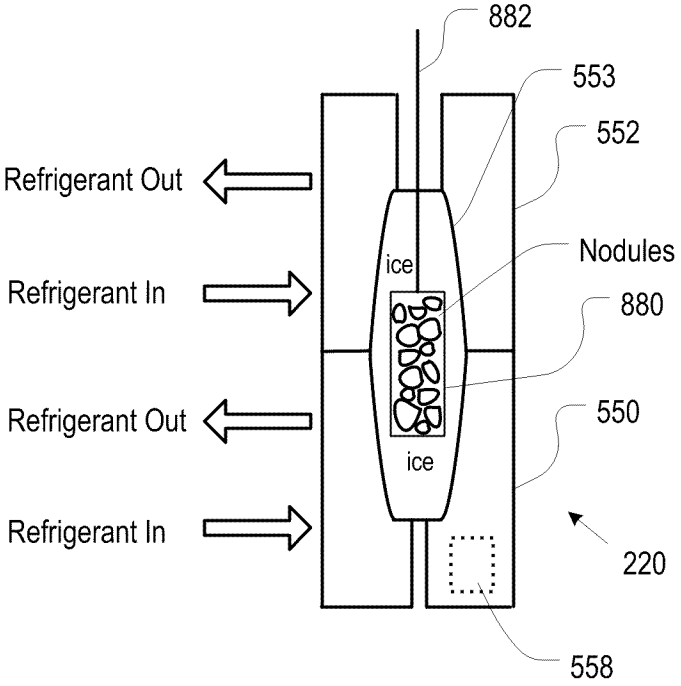
FIG. 8A depicts a first alternative method for generating a buoyant body using the buoyant body generator of FIG. 5.

FIG. 8A depicts a first alternative embodiment of the operation of buoyant-body generator 220. In this embodiment, the nodules are first loaded into container 880, which is suspended, via cable 882, within refrigeration chamber 553. This embodiment avoids the two-step freezing process previously described wherein the lower half of the buoyant body is first formed, nodules are added, and then the upper half of the buoyant body is formed.

FIG. 8B depicts a second alternative embodiment of the operation of buoyant-body generator 220. In the embodiment that is depicted in FIG. 8B, an ice slurry is formed, pumped into refrigeration chamber 553, and then the freezing process is completed.

The formation of ice around a nodule creates the buoyancy needed to lift the nodule to the surface. Table 1 below provides seawater density (kg/m$^3$) as function of depth (meters) and temperature (° C.). The data from this table is used for comparison with data for other liquids and ice to estimate the amount of ice (or liquid) required for lift.

TABLE 1

Seawater Density as a Function of Temperature (Salinity of 35 ppt)

| DEPTH | 4 deg C. | 15 deg C. | 30 deg C. |
|---|---|---|---|
| 0 | 1027.78 | 1025.97 | 1021.72 |
| 3000 | 1041.50 | 1038.24 | 1034.33 |
| 6000 | 1054.54 | 1051.55 | 1046.37 |

Comparing Table 2, below, to Table 1 above shows that ice is about ten percent less dense than seawater at the surface. Furthermore, whereas the bulk modulus of seawater is $2.35\times10^9$ Pa, the bulk modulus of ice is $7.81\times10^9$ Pa. The higher bulk modulus of ice indicates that seawater gains density with depth faster than ice.

TABLE 2

Properties of Ice

| | |
|---|---|
| Surface Density | 916 kg/m$^3$ |
| Bulk modulus | $7.81\times10^9$ Pa |

The property data indicates that a minimum of about ten kilograms of ice is required to lift a kilogram of manganese nodules, with twenty kilograms of ice being more practical. It will take a total of $79*4.18*1000=3.3\times10^6$ joules of refrigeration power to produce 10 kilograms of ice.

In practice, the ice block that is produced must be made sufficiently large to account for melting that occurs as the block rises to the surface. This significantly increases the amount of ice that is required. To decrease melting loses, in some embodiments, the buoyant body comprises ice as well as a thermally-insulating shell that covers the ice.

The rise time for the buoyant body can be computed by determining its terminal velocity. An object rising (or falling) through a fluid under its own weight reaches a terminal velocity if the net force acting on the object becomes zero. In other words, terminal velocity is reached when the weight of the object is exactly balanced by the buoyancy force and the drag force.

The drag force, $F_d$, is given by the expression:

$$F_d=0.5C_d\rho A_pV^2 \quad [1]$$

Where:

$F_d$ is the drag force $C_d$ is the drag coefficient

P is the fluid density $A_p$ is the projected area the buoyant body

V is the velocity of the buoyant body

The projected area of the buoyant body, as a sphere, is approximately:

$$A_p=\pi(3V_L/(4\pi))^{2/3} \quad [2]$$

where: $V_L$ is the volume of the buoyant body

Figure 10:
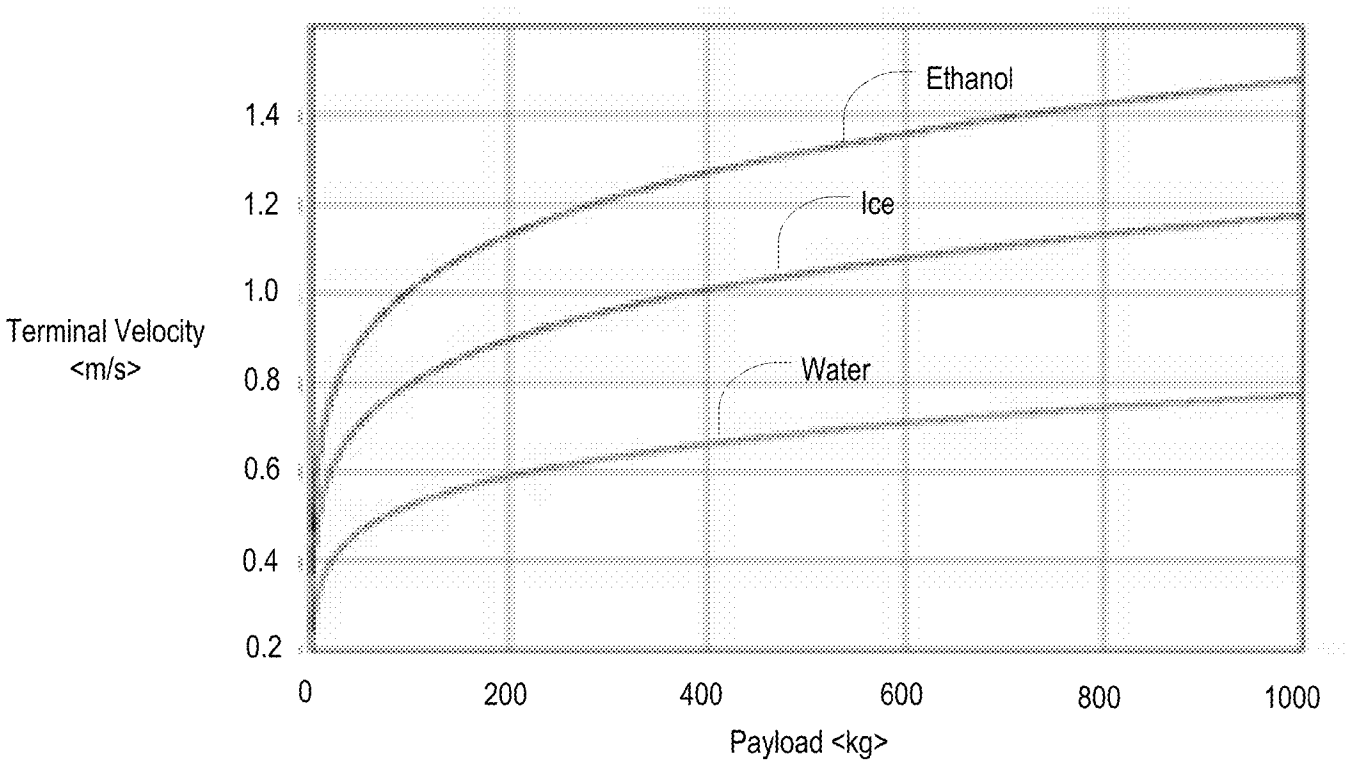
FIG. 10 depicts three plots showing the terminal velocity of a buoyant body based ethanol, ice, or water, as a function of the weight of the buoyant body.

FIG. 10 depicts, via three plots, the results of a simplified (assuming $C_d$=4, lift twice gross payload) terminal velocity model based on the use of ethanol, ice, or water as the buoyant body. These terminal velocities correspond to a rise time that varies as a function of depth, gross payload, and composition of the buoyant body. Assuming that the buoyant body is on the seabed at a depth of 6000 meters and that it reaches terminal velocity immediately after release, approximate rise time for ice for two different gross payloads are shown below in TABLE 3. For use in this disclosure and the appended claims, the term "gross payload" refers to the total mass being lifted; that is, the mass of the buoyant body as well as the mass of the material (e.g., nodules, etc.) that is being lifted by the buoyant body. The term "payload" refers to the mass of the material that is being lifted by the buoyant body.

TABLE 3

| Rise Time as a Function of Gross Payload Using Ice as the Buoyant Material | |
|---|---|
| RISE TIME FOR A 100 KG GROSS PAYLOAD <HRS> | RISE TIME FOR A 1000 KG GROSS PAYLOAD <HRS> |
| 2.1 | 1.4 |

Larger buoyant bodies will rise faster due to improved surface area to mass/volume ratios and the plots depicted in FIG. 10 reflect this. This creates an economic incentive to use relatively larger gross payloads. In particular, the greater ascent rates improve transport efficiency.

Figures 9A, 9B, 9C:
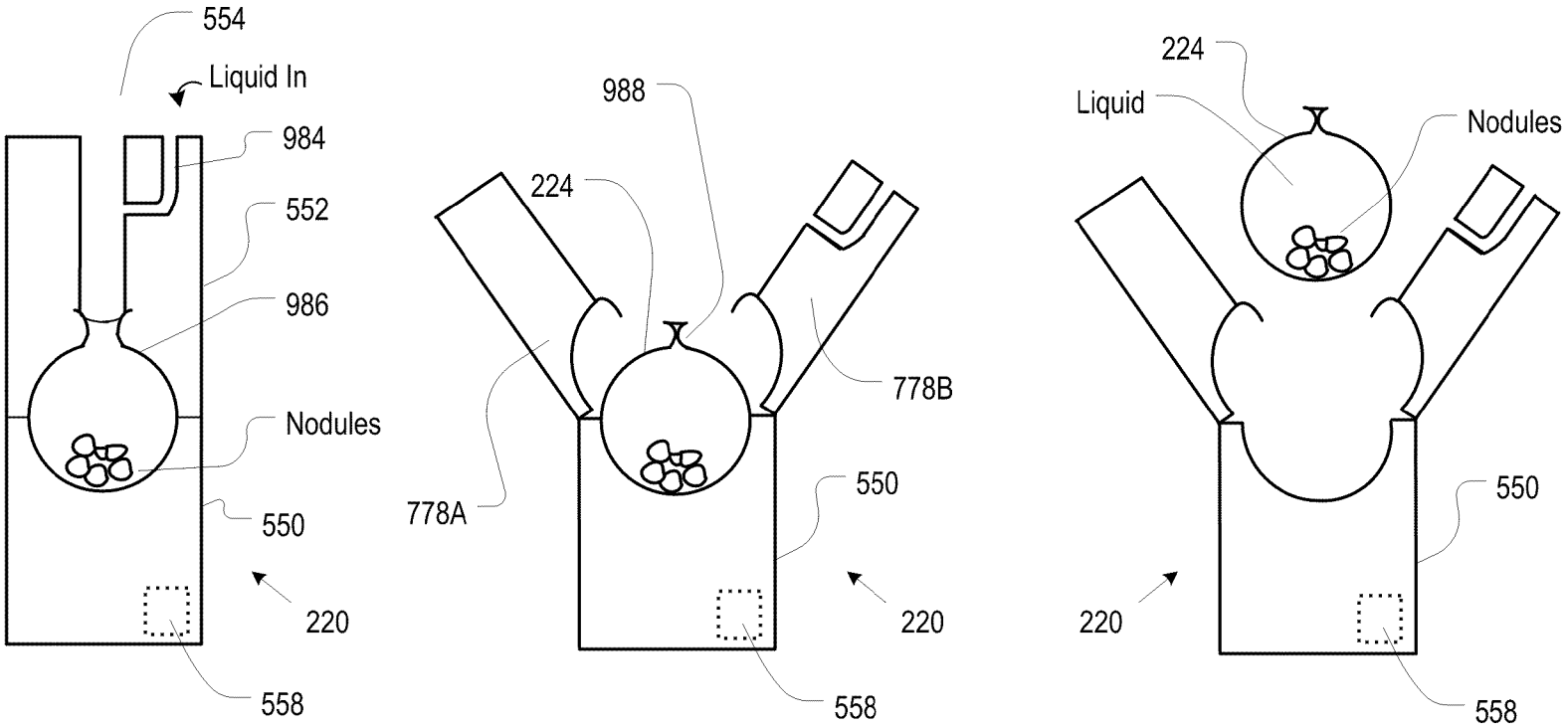
FIGS. 9A-9C depict a second embodiment of a buoyant body generator and a method for generating a buoyant body using it.

As an alternative to ice, liquids that are less dense than seawater can be used to create the buoyant body. FIGS. 9A through 9C depict the release of a buoyant body from an embodiment of buoyant-body generator 220 that is suitable for creating liquid-filled buoyant bodies.

In the embodiment depicted in FIGS. 9A through 9C, buoyant-body generator 220 comprises lower jacket 550, upper jacket 552, nodule inlet 554, and controller 558. Liquid inlet 984 is provided in upper jacket 552.

Flexible enclosure 986 (e.g., bladder, balloon, etc.) is disposed at the distal end of nodule inlet 554. Nodules are loaded into enclosure 986 via nodule inlet 554. Liquid is added to the enclosure via liquid inlet 984. This liquid is delivered to buoyant-body generator 220 via conduit 222 (FIG. 6), for example. Buoyant-body generator 220 is appropriately configured (e.g., piping, valving, drains, etc.) to prevent introduction of seawater into enclosure 986. The operation of generator 220 is controlled by controller 558, which, in some embodiments, receives instructions from system controller 202 (FIG. 2).

FIG. 9B depicts upper jacket 552 opening in preparation for the release of newly-formed buoyant body 224. In the embodiment depicted in FIG. 9B, upper jacket 552 is segmented into two halves, depicted as segments 778A and 778B, which are hingeably connected to lower jacket 550. FIG. 9C depicts buoyant body 224 after its release from buoyant body generator 220.

Liquids that are used as the buoyant fluid must be less dense than seawater and will advantageously be environmentally benign. Relatively few liquids possess both of these characteristics. Fresh water is a suitable liquid. A second liquid that is suitable for use as a buoyant fluid in conjunction with buoyant body generator 220 is ethanol. Ethanol is less dense the seawater and, although toxic in high concentrations, readily dilutes in water and degrades in the environment.

Table 4 below presents the density of freshwater as a function of depth and temperature. The temperature of the freshwater tends to equilibrate with the ocean, but will start out at about 4 degree C.

TABLE 4

| Freshwater Density as a Function of Temperature and Depth | | | |
|---|---|---|---|
| DEPTH | 4 deg C. | 15 deg C. | 30 deg C. |
| 0 | 999.97 | 999.10 | 995.65 |
| 3000 | 1014.53 | 1012.85 | 1008.79 |
| 6000 | 1028.32 | 1025.95 | 1021.31 |

The property data from Tables 1 and 4 indicates that the density of freshwater is typically about two to three percent less than ocean water. Therefore, a mass of freshwater within the range of about 30 to 50 times the mass of a nodule will be required for lift. Allowing a margin of 2, the buoyant body should therefore typically contain about 100 liters of fresh water per kilogram of manganese nodules. As previously discussed, water can be either produced at depth via reverse osmosis or pumped down from the surface.

Table 5 below shows properties of ethanol. Comparison with Table 1 shows that ethanol is more than 20 percent less dense than seawater at the surface. The bulk modulus of ethanol is about half that of seawater; therefore, ethanol is about twice as compressible as seawater. As a consequence, the density of ethanol increases with depth more rapidly than seawater. Relative to its density at the surface, the density of seawater increases by about three percent at 6000 meters. The density of ethanol therefore increases about six percent at 6000 meters. The difference in density of ethanol and seawater at 6000 meters will therefore be about 16 percent. This indicates that about 6.5 liters of ethanol will be required to lift a kilogram of nodules. Allowing a margin of 2, the buoyant body should therefore typically contain about 12 to 13 liters of ethanol per kilogram of manganese nodules.

TABLE 5

| Properties of Ethanol | | |
|---|---|---|
| Temp <deg. C.> | Density <kg/m$^3$> | Bulk Modulus <Pa> |
| 0 | 0.806 | $1.02 \times 10^9$ |
| 20 | 0.789 | $0.902 \times 10^9$ |
| 40 | 0.772 | $0.789 \times 10^9$ |

Table 6 depicts approximate rise times for a buoyant body using either ethanol or water as the buoyant material. These times are based on data from FIG. 10 and are based on the assumption that the buoyant body is on the seabed at a depth of 6000 meters and that it reaches terminal velocity immediately after release.

TABLE 6

| Rise Time as a Function of Buoyant Material and Gross Payload | | |
|---|---|---|
| BUOYANT MATERIAL | RISE TIME FOR A 100 KG GROSS PAYLOAD <HRS> | RISE TIME FOR A 1000 KG GROSS PAYLOAD <HRS> |
| Ethanol | 1.7 | 1.1 |
| Water | 3.3 | 2.1 |

In the prior art, gas has been used to lift magnesium nodules to the surface. As discussed in the Background section, that approach is particularly energy inefficient. At an operational depth of 6000 meters, about three liters of gas at STP must be generated per gram of material to be lifted. If sodium is reacted with water, approximately ten grams of sodium will be required (i.e., 10 kilograms of sodium per kilogram of nodule lifted) and about 2 mega joules are required per kilogram of nodules lifted. Most of this energy is expended in the rapid rise. In addition, there are inefficiencies associated with the chemical processes used to produce the gases. For example, when produced via sodium, much energy is lost due to the large amount of heat that is generated.

In some embodiments of the present invention, gas is generated to supplement the buoyancy of an ice- or liquid-based buoyant body. The gas can be produced, for example, by reacting sodium with water or squibs (similar to those used for inflating automobile air bags). In all embodiments in which gas supplementation is used, some type of enclosure must be used to contain the gas.

Although the use of gas to raise minerals from the seabed is problematic (very energy inefficient) as practiced in the prior art, its use in conjunction with the systems disclosed herein is particularly advantageous. For example, ice melts during the ascent of the buoyant body to the surface, resulting in a loss of buoyancy. Generating gas at a pre-defined depth (e.g., after some melting occurs, etc.) will compensate for this loss in buoyancy and accelerate the ascent. Gas is formed after the buoyant body begins its ascent to the surface. In comparison with generating gas at a relatively greater depths (i.e., at the seabed), less energy will be expended per mass of nodule when generating gas at relatively shallower depths. Furthermore, the gas will provide positive floatation once the buoyant body reaches the surface, thereby providing more time for nodule recovery. The depth at which gas is formed, which is to a certain extent arbitrary, can be based, for example, on achieving a certain rise time to the surface. That involves determining the rate at which the buoyant body melts, the affect of melting on buoyancy/rate of ascent, the increase in buoyancy/rate of ascent due to gas, etc. It is within the capabilities of those skilled in the art to determine the depth at which gas is to be generated, as a function of the aforementioned or other considerations.

Figure 11:
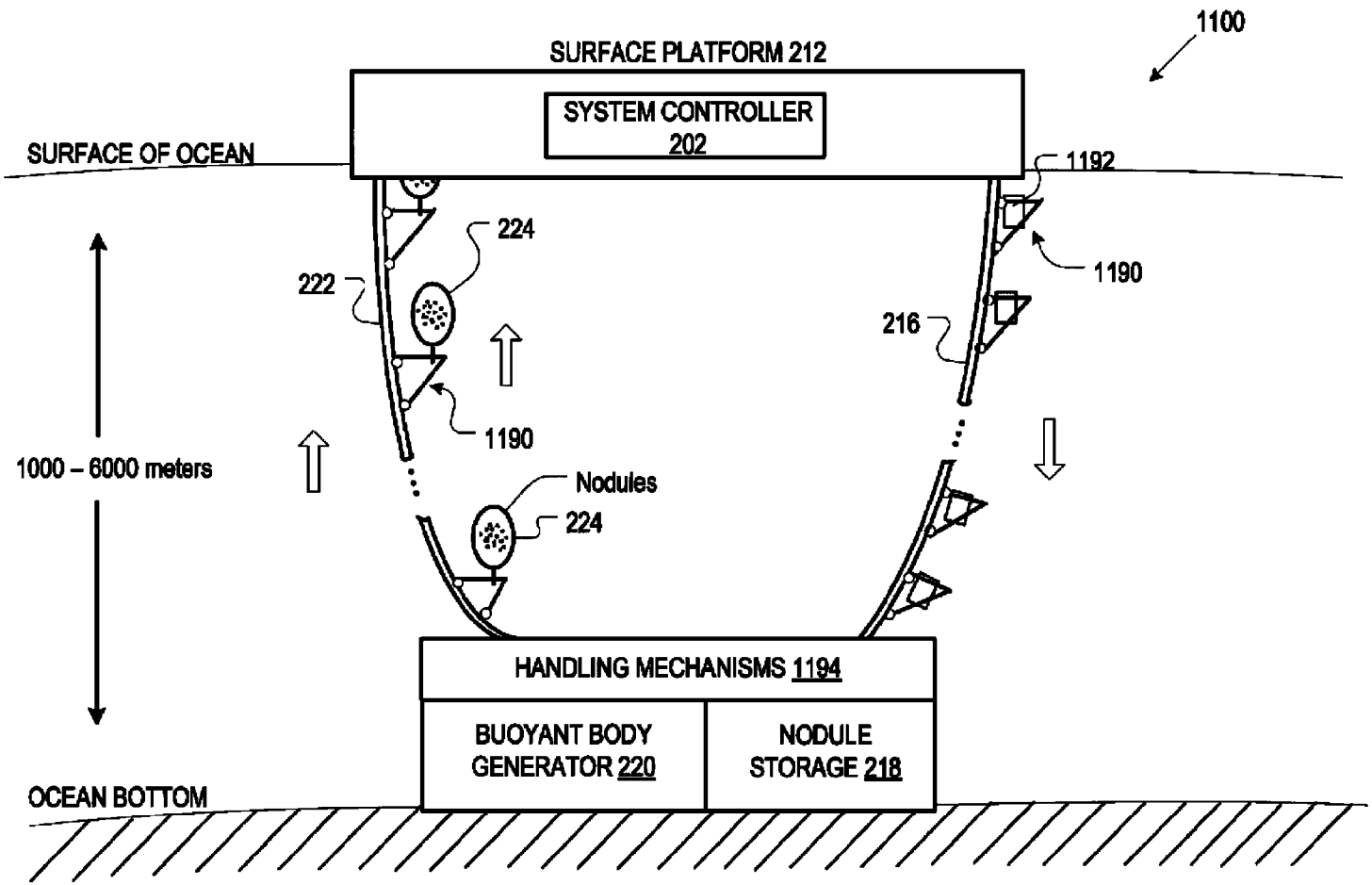
FIG. 11 depicts a second embodiment of the system of FIG. 1.

FIG. 11 depicts second embodiment 1100 of system 100. In this embodiment, transport functionality 110 (see, FIG. 1) is implemented via a discrete transport system. That is, the buoyant bodies are not simply released to float to the surface; rather, they are tethered or otherwise connected to a guide system.

As in first embodiment 200 of system 100, system control functionality 102 is implemented via system controller 202, nodule collection functionality 104 is implemented via a conventional nodule collector (not depicted), nodule storage functionality 106 is implemented via nodule storage facility 218, and buoyant-body generation functionality 108 is implemented via buoyant-body generator 220.

Transport functionality 110 is implemented via a plurality of carriers 1190. Carriers are delivered to the seabed via gravity along a cable, such as power cable 216, as convenient. The carriers are coupled to the cable in any convenient manner for descent (see, e.g., FIGS. 12, 13, 14A). To the extent that buoyant bodies 224 incorporate some type of flexible enclosure for enclosing the buoyant material (e.g., ice, liquid, etc.), that enclosure 1192 is coupled to carrier 1190 for descent.

At the seabed, carriers 1190 and enclosures 1192 (if present) are engaged by various handling mechanisms 1194 to:

- couple carriers 1190 to a second cable, such as cable 222;
- shuttle enclosures 1192 to the buoyant body generator to generate buoyant bodies 224, in some embodiments; and
- couple buoyant bodies 224 to carriers 1190 for transport to the surface.

Although a two-cable (separate ascent and descent) system is depicted in the embodiment shown in FIG. 11, in some other embodiments, a single cable is used for both ascent and descent. In a two-cable system, ascent and descent operations can occur simultaneously while in a one-cable system, these operations must be performed sequentially. But a single-cable system greatly simplifies handling issues (e.g., avoids engagement and reengagement of carriers 1190 as well as having to shuttle carriers between the two cables, etc.).

FIGS. 12, 13, 14A, and 14B depict an embodiment of carrier 1190 and an embodiment of handling mechanisms 1194, as are used for some embodiments of two-cable transport systems.

Figure 12:
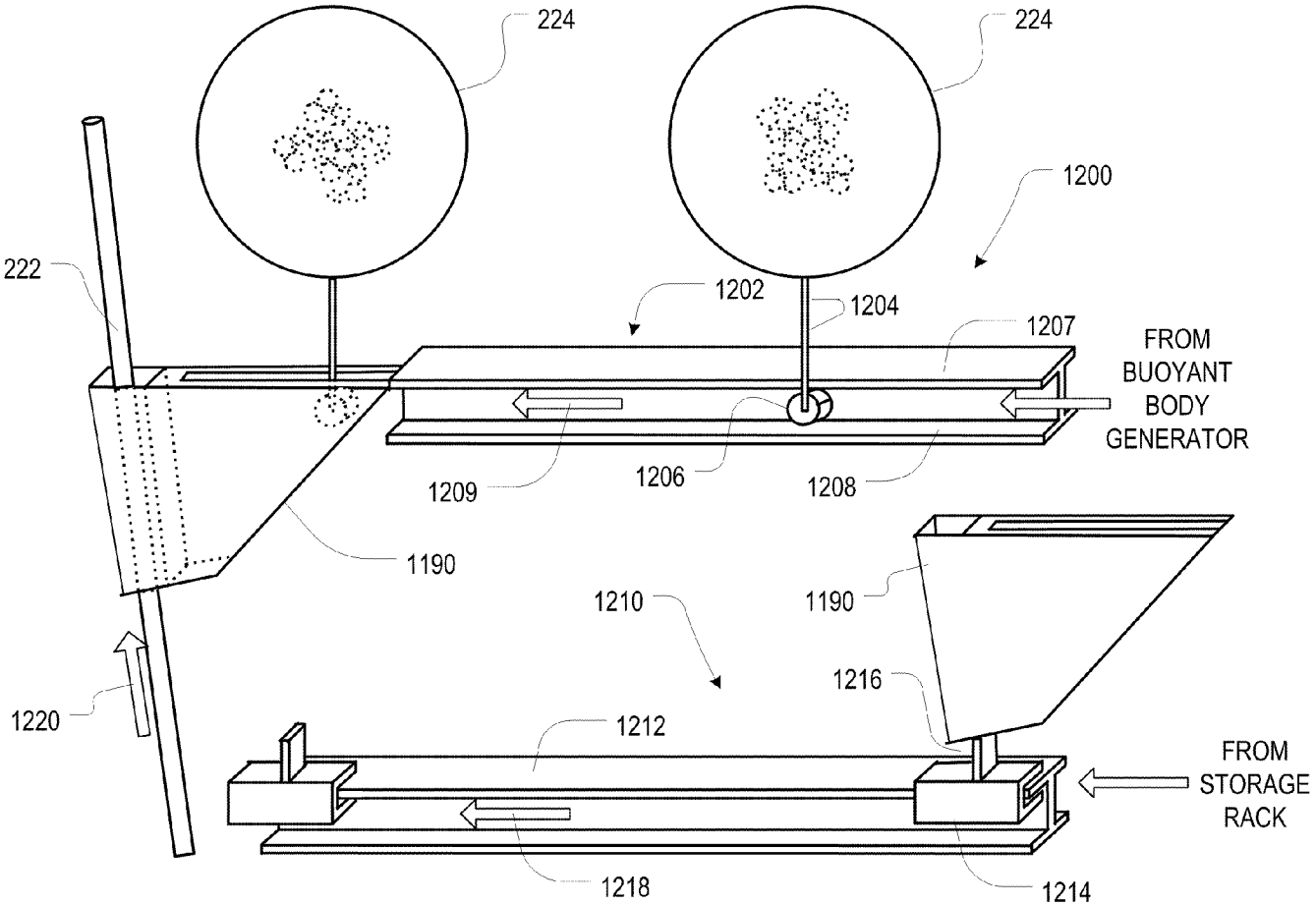
FIG. 12 depicts an embodiment of a handling system for use in conjunction with the embodiment of FIG. 11.

FIG. 12 depicts specific embodiments of handling mechanisms 1194. More particularly, FIG. 12 depicts buoyant-body shuttling mechanism 1200 for delivering and engaging buoyant bodies 224 to carriers 1190 and carrier shuttling mechanism 1210 for delivering and engaging carriers 1190 to a cable for ascent to the surface.

As depicted in FIG. 12, carrier shuttling mechanism 1210 comprises guideway 1212, coupler 1214, and carrier drive 1218, interrelated as shown.

In the illustrative embodiment, guideway 1212 has a structure similar to an "I-beam." Couplers 1214 engage one of the lateral surfaces of guideway 1212. In the illustrative embodiment, coupler 1214 has a "c"-type structure to facilitate engaging the guideway. Arm 1216, which extends upward from each coupler 1214, engages carrier 1190.

In some embodiments, the cable that is being used to transport carriers 1990 to the seabed (i.e., cable 216 in FIG. 11) is arranged with respect to guideway 1212 so that carriers 1190, upon reaching the ocean bottom, are positioned to directly engage couplers 1214. In some other embodiments, various intermediate handling systems are used to conduct carriers 1190 from cable 216 to couplers 1214 on guideway 1212.

Carrier drive 1218, which is not depicted in structural detail, functions to advance coupler 1214 and its engaged carrier 1190 toward cable 222. Carrier drive 1218 advances the coupler and the carrier to the point at which carrier 1190 engages drive 1220. The engagement operation is described in further detail in conjunction with FIGS. 13 and 14A. Drive 1220, which is not depicted in structural detail, advances carrier 1190 into position to receive buoyant body 224 from buoyant-body shuttling mechanism 1200.

Carrier drive 1218 can be any type of drive mechanism suitable for conveying coupling 1214 along guideway 1212. For example, carrier drive 1218 can be a chain drive with fingers that engage couplers 1214 and drag them along guideway 1212. After reading this specification, those skilled in the art will be able to design and build any of a variety of different types of drives 1218 suitable for moving couplers 1214 along guideway 1212. Drive 1220 can be the same type of drive as carrier drive 1218 or any other suitable design as will occur to those skilled in the art after reading this specification.

FIG. 12 also depicts buoyant-body shuttling mechanism 1200, which comprises guideway 1202 and buoyant-body drive 1209, interrelated as shown.

Buoyant body 224 is conveyed from buoyant body generator 220 to buoyant body shuttling mechanism 1200 (conveyance system not depicted). To facilitate shuttling buoyant body 224 to the transport system and using it with carriers 1190, arm 1204 is coupled to the buoyant body. In some embodiments, such as when buoyant body 224 comprises ice, arm 1204 can be frozen into buoyant body 224 during the formation of the buoyant body. In some other embodiments, arm 1204 is integral or otherwise attached to the outside of an enclosure (e.g., see FIG. 9A, enclosure 986, etc.) that is used in some embodiments.

Roller 1206 depends from arm 1204 and is free to rotate relative to arm 1204. After being conveyed to buoyant body shuttling system 1200, roller 1206 is engaged to guideway 1202 by positioning it between two laterally-projecting surfaces 1207 and 1208 of the I-beam-shaped guideway.

Buoyant-body drive 1209, which is not depicted in structural detail, advances buoyant body 224 toward cable 222. For example, in some embodiments, drive 1209 can "push" arm 1204 so that roller 1206 rolls along guideway 1202 between surfaces 1207 and 1208. Buoyant-body drive 1209 eventually advances buoyant body 224 to the point at which roller 1206 couples to carrier 1190. The engagement operation is described in further detail in conjunction with FIGS. 13 and 14B.

Once released from guideway 1202, the buoyant body, along with engaged carrier 1190, rises (since the combination of the buoyant body and the carrier is positively buoyant), disengaging from drive 1220. Lateral movement of buoyant body 224 on its way to the surface is restricted due to its engagement to carrier 1190.

When buoyant body 224 and accompanying nodules reach the surface of the water, carrier 1190 is disengaged from cable 222 and the carrier and buoyant body 224 are recovered by a surface crew. Once on platform 102 (see, FIG. 11), buoyant body 224 is disengaged from carrier 1190 and the nodules are separated from the buoyant body. The carrier is then coupled to cable 216 for its return to the seabed.

Figure 13:
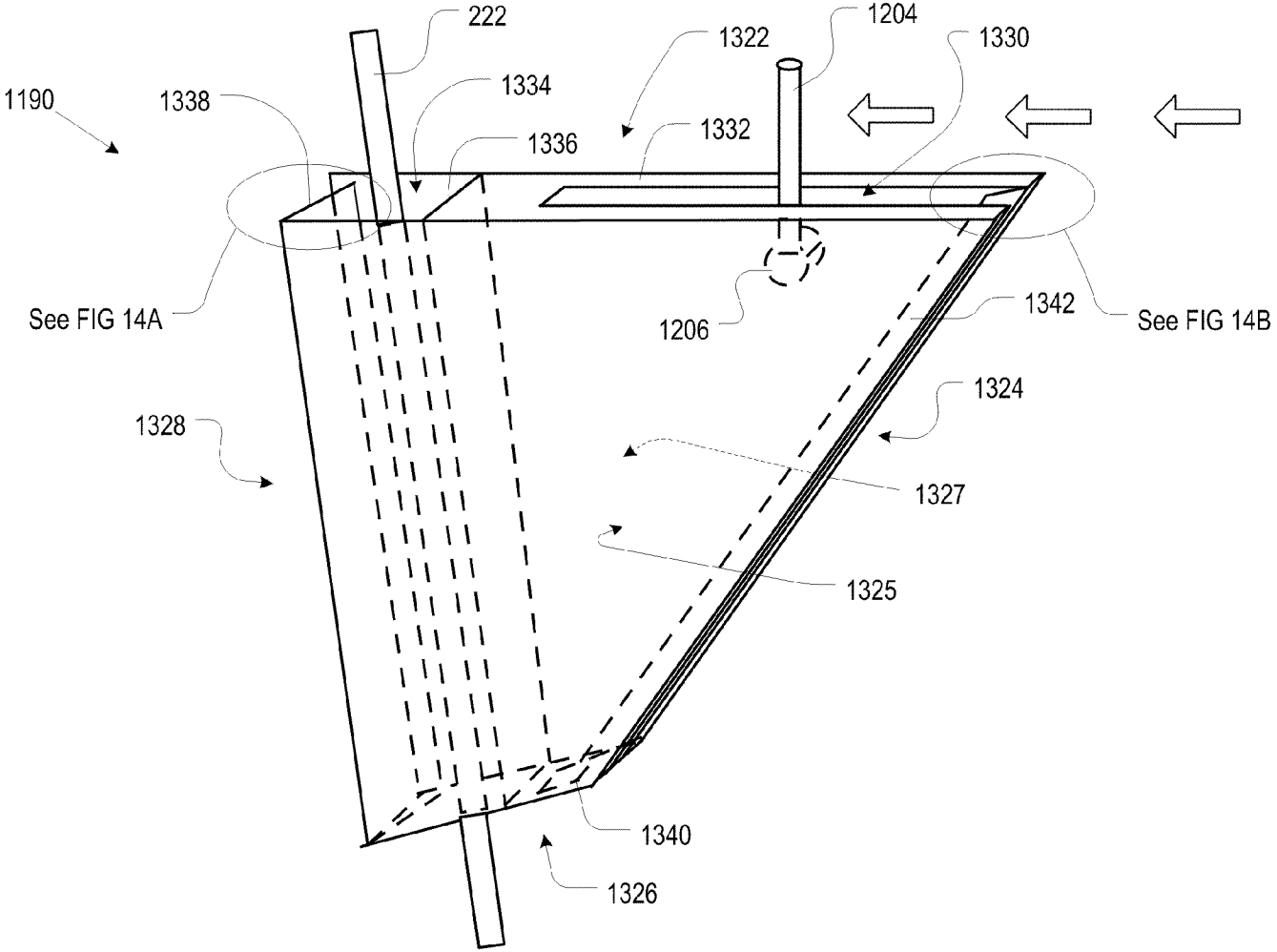
FIG. 13 depicts further detail of a carrier for use in conjunction with the handling system of FIG. 12.
Figure 14B:
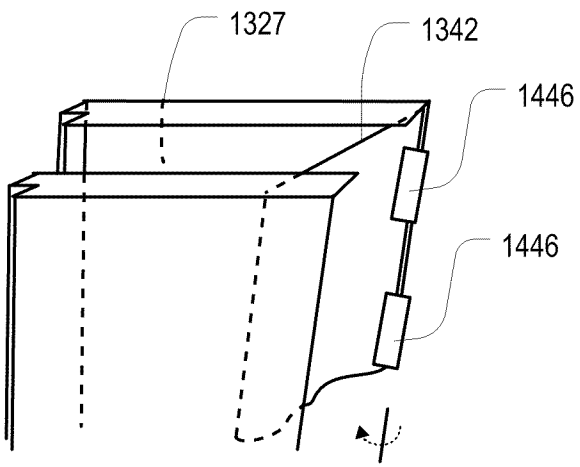
FIGS. 14A and 14B depict further detail of the carrier of FIG. 13.
Figure 14A:
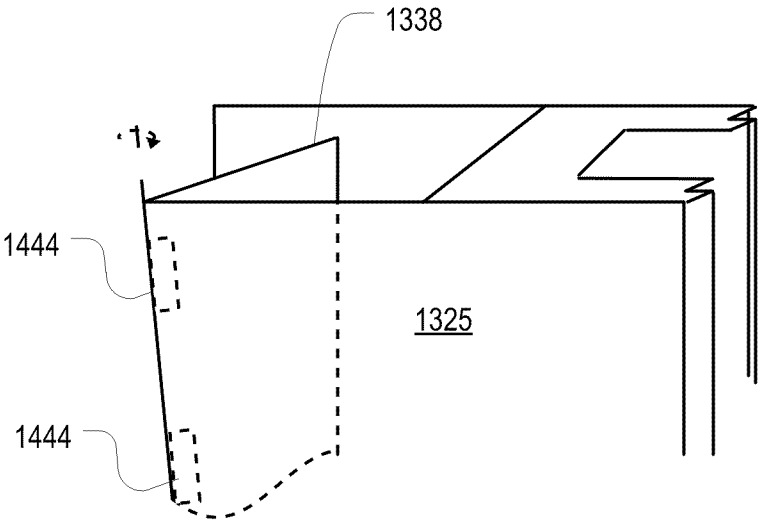

FIG. 13 depicts further detail of carrier 1190. In the illustrative embodiment, carrier 1190 has a truncated triangular shape and includes (upper) surface 1322, (right) side 1324, (front) face 1325, bottom 1326, (back) face 1327, and (left) side 1328. It is to be understood that the designations "front," "back," "left," and "right" are meaningful only with respect to the orientation depicted in FIG. 13; they have no significance other than to facilitate description.

Cable-receiving region 1334 is defined between face 1325, face 1327, internal partition 1336 and (left) side wall 1338. Buoyant-body receiving region 1330 is defined between face 1325, face 1327, internal partition 1336 and (right) side wall 1342.

Bottom 1326 includes opening 1340 for receiving arm 1216, which extends upward from each coupler 1214 (see, FIG. 12). This enables carrier 1190 to engage carrier shuttling mechanism 1210.

As depicted in FIG. 13, when carrier 1190 is coupled to cable 222, the cable is disposed in cable-receiving region 1334 proximal to (left) side 1328 of carrier 1190. The coupling process is now described with reference to FIGS. 12, 13, and 14A.

As carrier 1190 is moved along guideway 1212, side 1328 approaches cable 222. Eventually, side wall 1338 contacts cable 222. Side wall 1338 is coupled to face 1325 via spring-loaded hinges 1444. As carrier drive 1218 continues to urge carrier towards cable 222, side wall 1338 swings inward such that the cable moves into cable-receiving region 1334. Once cable 222 clears side wall 1338, spring-loaded hinges 1444 return side wall 1338 to an orientation that is substantially perpendicular to both faces 1325 and 1327. In other words, the "doorway" (i.e., side wall 1338) "closes," effectively sealing cable-receiving region 1334.

As depicted in FIG. 13, when buoyant body 224 (not depicted for clarity) is coupled to carrier 1190, roller 1206 and arm 1204 engage region 1330 proximal to (upper) surface 1322 of the carrier. The coupling process is now described with reference to FIGS. 12, 13, and 14B.

As buoyant body 224 is moved along guideway 1202, arm 1204 and roller 1206 approaches (right) side 1324 of carrier 1190. Eventually, roller 1206 and arm 1204 contact (right) side wall 1342 of the carrier. Side wall 1342 is coupled to face 1327 via spring-loaded hinges 1446. As buoyant-body drive 1209 continues to urge buoyant body 224 towards carrier 1190, roller 1206 and arm 1204 force side wall 1342 to swing inward such that the roller and arm move into buoyant-body receiving region 1330. Once the roller and arm clear side wall 1342, spring-loaded hinges 1446 return side wall 1342 to an orientation that is substantially perpendicular to both faces 1325 and 1327. This seals buoyant-body receiving region 1330.

As buoyant body 224 ascends toward the surface, upper surface of roller 1206 bears against the inward-projecting surfaces 1332 at (upper) face 1322 of the carrier. These inward-projecting surfaces effectively prevent the buoyant body from decoupling from the carrier. As a consequence, carrier 1190 rises toward the surface, dragged by buoyant body 224. Since carrier 1190 is coupled to cable 222, lateral movement of buoyant body 224 is limited to movement within the opening formed between the inward-projecting surfaces 1332 at (upper) face of carrier 1190.

It will be appreciated that other embodiments of carrier 1190 are possible. For example, in some embodiments, the carrier incorporates two sets of two rollers that engage cable 222. The carrier opens to admit the cable, which is (automatically) positioned between the rollers. The carrier then closes, effectively coupling itself to the cable for ascent to the surface.

Figure 15:
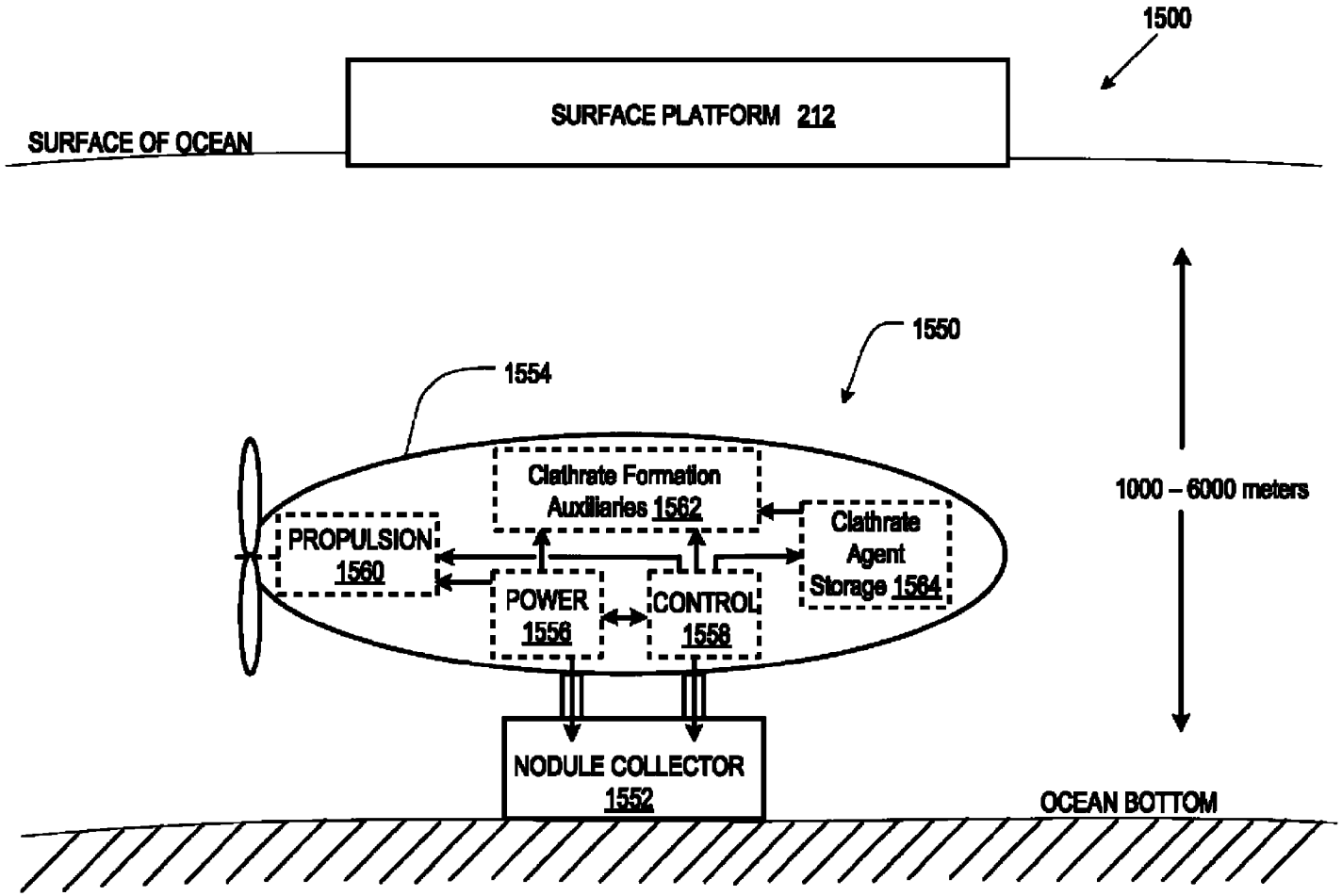
FIG. 15 depicts a third embodiment of the system of FIG. 1.

FIG. 15 depicts third embodiment 1500 of system 100. In this embodiment, clathrate ice is the buoyancy-creating material. Control functionality 102, nodule collection functionality 104, nodule storage functionality 106, and buoyant-body generation functionality 108, and transport functionality 110 is implemented via a single, functionally-integrated collection and transport vessel 1550.

Clathrate compounds are crystalline solids that occur when water molecules form a cage-like structure around smaller "guest" molecules ("clathrating agents"). In clathrates, water crystallizes as a cubic system, rather than in the hexagonal structure of normal ice. Common clathrating agents include methane, ethane, propane, fluoro-propane, fluoro-methane, fluoro ethane, isobutane, normal butane, other light hydrocarbons, hydrocarbon mixtures, anti-freeze compounds, R141B, nitrogen, carbon dioxide and hydrogen sulfide.

Clathrate ices form under moderate pressure (typically a few MPa) and at cold temperatures (typically close to 0° C., but increased pressure raises the melting point). The material properties of a clathrate compound are dependent upon the specific type(s) of chemical used as the clathrating agent(s), the presence of additives, as well as the ratio of the agent(s) to water. As a result, a clathrate compound that will freeze under the prevailing pressures and deep ocean water temperatures can readily be formed by one skilled in the art. For example, methane clathrates remain stable up to 18° C. at elevated pressure.

Vessel 1550 comprises flexible enclosure 1554 and nodule collector 1552. In some embodiments, nodule collector 1552 takes the form of conventional nodule collector 214, as depicted in FIG. 3. Nodule collector 1552 provides collection functionality 104 and storage functionality 106.

The formation of clathrate ice within enclosure 1554 provides buoyant-body generation functionality 108. Clathrate agent(s) is stored within enclosure 1554 in clathrate agent storage region 1564. Either gaseous or liquid clathrating agents may be used. If gaseous clathrating agents are used, in some embodiments, they are pressurized to liquefy them before being transported to depth. Methane or R141B, for example and without limitation, can be used as the clathrating agent since both form clathrate ice at depth and above the deep ocean temperature. In some embodiments, the clathrate agent includes anti-freeze to adjust freezing temperature as desired and emulsification agents to improve the mixing of the clathrating agent(s) with water.

Clathrate formation auxiliaries 1562 are used, in conjunction with the stored clathrate agent(s), to generate clathrate ice. In some embodiments, auxiliaries 1562 include, without limitation, a mixing system to mix clathrating agent(s) and water, a means to promote heat exchange, such as fins, heat exchange surfaces, heat pipes, or heat exchangers. Those skilled in the art, after reading this disclosure, will be able to design and implement a system to generate clathrate ice within enclosure 1554.

Vessel 1550 also includes propulsion system 1560, which in the illustrative embodiment, includes a propeller and engine, etc., that drives the propeller.

Power supply 1556 (e.g., batteries, etc.) and control system 1558 (e.g., microprocessor running appropriate software, processor-accessible memory, etc.) provide power to and direct the operation of the various on-board systems, such as propulsion 1560, clathrate ice formation, as well as nodule collection via collector 1552. Although depicted as being within enclosure 1554, power supply 1556 and control system 1558 will typically be disposed in nodule collector 1552.

In operation, vessel 1550 descends to depth, nodules are collected by nodule collector 1552 until a maximum allowed weight is collected, clathrate ice is allowed to form by introducing the clathrating agent into water, and vessel 1550 then ascends as a consequence of the net positive buoyancy created by the presence of the clathrate ice. When vessel 1550 is at the surface, the clathrate ice melts.

The clathrate ice is characterized by an equilibrium vapor pressure for its clathrating agent (e.g., methane, etc.). The equilibrium vapor pressure is the minimum pressure required (which is a function temperature) to keep the clathrating agent from boiling out of the clathrate ice.

As vessel 1550 rises from the ocean bottom, the ambient temperature increases and ambient pressure decreases (i.e., the temperature and pressure of the sea water at a given depth). As a consequence, the hydrostatic pressure might not be sufficient to prevent the clathrating agent from boiling out of the clathrate compound.

In some embodiments, therefore, enclosure 1554 is pressure controlled to prevent the clathrating agent from boiling. In some embodiments, pressure is maintained via a spring loaded piston (not depicted), wherein one face of the piston is exposed to the seawater.

In some further embodiments (not depicted), nodule collector 1552 is capable of decoupling from enclosure 1554. In such embodiments, a plurality of nodule collectors 1552 can operate on the seabed. When a nodule collector reaches its capacity of nodules (or the limits of enclosure 1554 to lift the nodules), the enclosure "docks" with collector 1552. Clathrate ice is then allowed to form in enclosure 1554 and collector 1552 and the enclosure jointly ascend to the surface. Once emptied of its payload of nodules at the surface, the coupled enclosure and collector return to the seabed where they decouple. The collector then resumes its harvesting activities. Enclosure 1554 docks with another collector 1552 that is at capacity.

Figure 16:
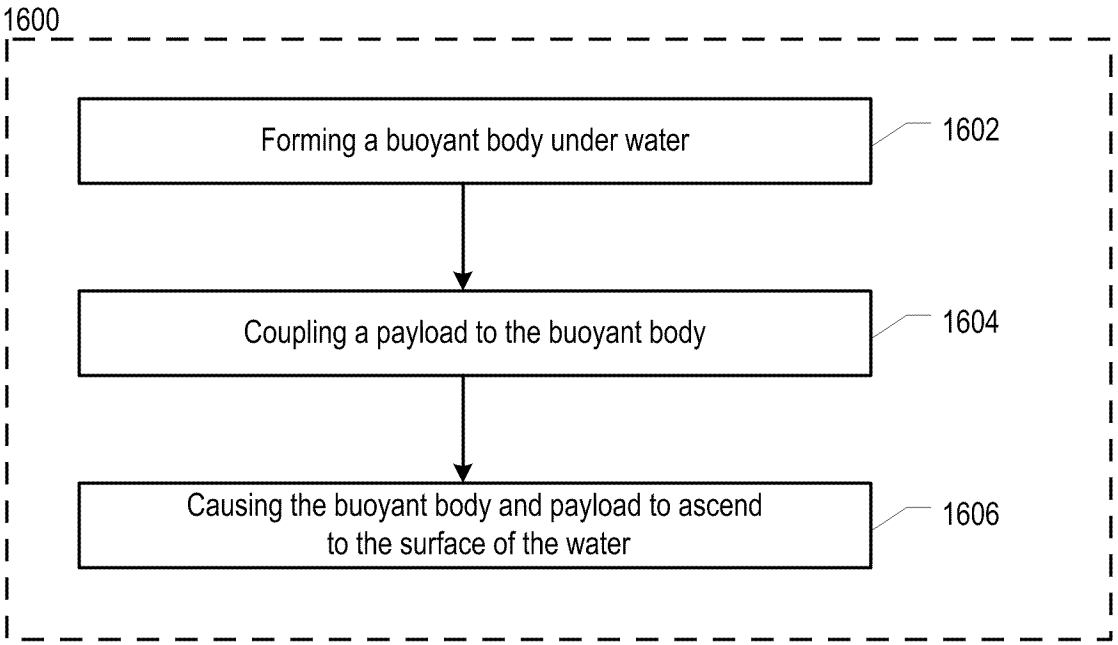
FIG. 16 depicts a method for transporting a payload, such as minerals, from the seabed to the surface.

FIG. 16 depicts method 1600, which is applicable to embodiments 200, 1100, and 1500, of system 100. Method 1600 recites the operations of:

1602: Forming a buoyant body under water;

1604: Coupling a payload to the buoyant body; and

1606: Causing the buoyant body and payload to ascend to the surface of the water.

As previously described, operation 1602, which recites "forming a buoyant body under water" is performed in one of several ways via the following sub-operations:

(1) freezing seawater or fresh water; or (2) introducing a liquid that is less dense than seawater into a bladder; or (3) performing (1) or (2) at a first depth and generating gas at a second depth that is less deep than the first depth; or (4) forming clathrate ice.

Of course, the sub-operations listed above are performed underwater. As used herein, the phrase "forming a buoyant body" is defined for use herein and the appended claims to mean any of the approaches listed above. This definition, however, explicitly excludes: (1) forming gas as the sole buoyancy-generating mechanism and (2) transporting solid, positively-buoyant materials (e.g. cork, etc.) to the seabed for use as the buoyancy-generating mechanism.

Operation 1604, which recites "coupling a payload to the buoyant body" is performed in one of several ways via the following sub-operations:

A. Integrating the payload (e.g., nodules, etc.) into the buoyant body during formation of the buoyant body.

(1) Embedding the payload directly in ice by:

(a) freezing a portion of the water in the refrigeration chamber, placing the payload on the ice, then freezing the remaining water; or (b) forming an ice slurry, mixing the payload into the slurry, freezing the slurry.

(2) Embedding a container in ice, wherein the container encases the payload, by: suspending the container within the refrigeration chamber and then freezing water in the refrigeration chamber.

(3) Disposing a liquid and the payload in an enclosure, wherein the liquid is less dense than seawater.

B. Forming the buoyant body and maintaining the payload in an enclosure that is separate from but coupled to the buoyant body.

(1) Forming clathrate ice in an enclosure, wherein the payload is maintained in a separate storage region that is coupled to the enclosure.

In some embodiments of method 1600, operation 1604 further includes the sub-operation of "collecting a payload." An example of this operation is collecting manganese nodules from the seabed. In some further embodiments of method 1600, operation 1604 further includes the sub-operation of temporarily storing the payload. In the context of the illustrative embodiment, an example of this is storing nodules in nodule collector 214 and/or in nodule storage facility 218.

Operation 1606, which recites "causing the buoyant body and payload to ascend to the surface of the water" is performed in one of several ways via the following sub-operations:

(1) Releasing the buoyant body from the buoyant body generator for unfettered ascent; or (2) Coupling the buoyant body to a transport system by coupling a carrier to a cable that extends from the surface of the water to the seabed and coupling the buoyant body to the carrier; or (3) In embodiments in which operation 1604 is performed via approach B(1), operation 1606 is subsumed in operation 1604. That is, the act of forming the clathrate ice in the enclosure causes the buoyant body and the payload to ascend to the surface of the water.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A method comprising:

forming a buoyant body in an electrically-powered buoyant body generator under water in a body of salt water by:

transporting fresh water from the surface to a site at which the buoyant body is to be formed; and freezing the fresh water;

coupling a payload to the buoyant body; and causing the buoyant body and payload to ascend to the surface of the water.

2. The method of claim 1 wherein the operation of forming a buoyant body under water further comprises:

disposing the payload in the fresh water before freezing the fresh water.

3. The method of claim 1 wherein the operation of coupling a payload to the buoyant body further comprises collecting the payload.

4. The method of claim 1 wherein the operation of coupling a payload to the buoyant body further comprises temporarily storing the payload.

5. A method comprising:

forming a buoyant body in an electrically-powered buoyant body generator under water in a body of salt water by:

desalinating the salt water; and freezing the desalinated salt water;

coupling a payload to the buoyant body; and causing the buoyant body and payload to ascend to the surface of the water.

6. The method of claim 5 wherein the operation of forming a buoyant body further comprises:

disposing the payload in the desalinated salt water before freezing the desalinated salt water.

7. A method comprising:

forming a buoyant body in an electrically-powered buoyant body generator under water in a body of salt water by:

transporting ethanol from the surface; and disposing a payload and the ethanol in a flexible enclosure; and causing the buoyant body to ascend to the surface of the water.

8. A method comprising:

forming a buoyant body in a buoyant body generator under water in a body of salt water by:

transporting, from the surface, a liquid that is less dense than seawater; and disposing a payload and the liquid in a flexible enclosure within the buoyant body generator; and causing the buoyant body to ascend to the surface of the water due to the positive buoyancy of the buoyant body relative to the salt water.

9. The method of claim 8 wherein the liquid is ethanol.

10. The method of claim 8 wherein operation of the buoyant body generator is controlled by a controller.

* * * * *